US007624981B2

(12) United States Patent
Biegelsen et al.

(10) Patent No.: US 7,624,981 B2
(45) Date of Patent: Dec. 1, 2009

(54) UNIVERSAL VARIABLE PITCH INTERFACE INTERCONNECTING FIXED PITCH SHEET PROCESSING MACHINES

(75) Inventors: David K. Biegelsen, Portola Valley, CA (US); Lars-Erik Swartz, Sunnyvale, CA (US); David G. Duff, Woodside, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 277 days.

(21) Appl. No.: 11/317,589

(22) Filed: Dec. 23, 2005

(65) Prior Publication Data

US 2007/0145676 A1 Jun. 28, 2007

(51) Int. Cl.
*B65H 5/00* (2006.01)

(52) U.S. Cl. ..... 271/264; 271/306; 198/588

(58) Field of Classification Search ..... 271/264, 271/272, 69, 306, 200, 314; 198/588
See application file for complete search history.

(56) References Cited

U.S. PATENT DOCUMENTS 4,579,446 A 4/1986 Fujino et al.
4,587,532 A 5/1986 Asano
4,836,119 A 6/1989 Siraco et al.
5,004,222 A 4/1991 Dobashi
5,078,385 A * 1/1992 Serita ..... 271/296
5,080,340 A 1/1992 Hacknauer et al.
5,095,342 A 3/1992 Farrell et al.
5,159,395 A 10/1992 Farrell et al.
5,208,640 A 5/1993 Horie et al.
5,272,511 A 12/1993 Conrad et al.
5,326,093 A * 7/1994 Sollitt ..... 271/306
5,435,544 A 7/1995 Mandel
5,473,419 A 12/1995 Russel et al.

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Patrick H Mackey
*Assistant Examiner*—Michael C McCullough
(74) *Attorney, Agent, or Firm*—Fay Sharpe LLP

(57) ABSTRACT

In accordance with one aspect of the present exemplary embodiment, a universal interface is provided for operatively connecting and feeding sequential copy sheet output of various selectable first sheet processing machines to various selectable second sheet processing machines spaced apart horizontally or horizontally and vertically from the first sheet processing machines by widely varying ranges of horizontal distances. The universal interface includes a frame and a universal interface module providing a sheet feeding path repositionable relative to the frame therethrough, from one side to the other of the module, for transporting the copy sheet output of the first sheet processing machine to the copy sheet input of the second sheet processing machine. Further, the universal interface module includes an integral horizontally or horizontally and vertically repositionable sheet receiving and sheet discharging sheet path ends opening at opposite sides of the universal interface module. At least one of the sheet receiving path end and the sheet discharging sheet path end are independently positionable relative to the other of the sheet receiving and sheet discharging sheet path ends over a horizontal range. In a further form, the universal interface module is bidirectional for a bidirectional paper path. Interdigitated sheet guides are provided for defining the sheet path in the bidirectional modules.

5 Claims, 6 Drawing Sheets

U.S. PATENT DOCUMENTS

| | | | | |
|---|---|---|---|---|
| 5,489,969 | A | 2/1996 | Soler et al. | |
| 5,504,568 | A | 4/1996 | Saraswat et al. | |
| 5,525,031 | A | 6/1996 | Fox | |
| 5,557,367 | A | 9/1996 | Yang et al. | |
| 5,568,246 | A | 10/1996 | Keller et al. | |
| 5,570,172 | A | 10/1996 | Acquaviva | |
| 5,596,416 | A | 1/1997 | Barry et al. | |
| 5,629,762 | A | 5/1997 | Mahoney et al. | |
| 5,710,968 | A | 1/1998 | Clark et al. | |
| 5,778,377 | A | 7/1998 | Marlin et al. | |
| 5,884,910 | A | 3/1999 | Mandel | |
| 5,941,518 | A * | 8/1999 | Sokac et al. | 271/10.05 |
| 5,995,721 | A | 11/1999 | Rourke et al. | |
| 6,059,284 | A | 5/2000 | Wolf et al. | |
| 6,125,248 | A | 9/2000 | Moser | |
| 6,241,242 | B1 | 6/2001 | Munro | |
| 6,297,886 | B1 | 10/2001 | Cornell | |
| 6,341,773 | B1 | 1/2002 | Aprato et al. | |
| 6,384,918 | B1 | 5/2002 | Hubble, III et al. | |
| 6,390,468 | B1 * | 5/2002 | Michel et al. | 271/264 |
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,819,906 | B1 | 11/2004 | Herrmann et al. | |
| 6,925,283 | B1 | 8/2005 | Mandel et al. | |
| 6,959,165 | B2 | 10/2005 | Mandel et al. | |
| 7,093,831 | B2 * | 8/2006 | Biegelsen et al. | 271/184 |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 * | 8/2004 | Biegelsen et al. | 271/303 |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 28, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/235,979, filed Sep. 27, 2005, Anderson et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/236,099, filed Sep. 27, 2005, Anderson et al.

* cited by examiner

UNIVERSAL VARIABLE PITCH INTERFACE INTERCONNECTING FIXED PITCH SHEET PROCESSING MACHINES

CROSS REFERENCE TO RELATED PATENTS AND APPLICATIONS

The following applications, the disclosures of each being totally incorporated herein by reference are mentioned:

application Ser. No. 11/212,367, filed Aug. 26, 2005, entitled "PRINTING SYSTEM," by David G. Anderson, et al., and claiming priority to U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES";

application Ser. No. 11/235,979, filed Sep. 27, 2005, entitled "PRINTING SYSTEM," by David G. Anderson, et al., and claiming priority to U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE", and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

application Ser. No. 11/236,099, filed Sep. 27, 2005, entitled "PRINTING SYSTEM," by David G. Anderson, et al., and claiming priority to U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE", and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

U.S. application Ser. No. 10,761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Robert M. Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al.;

U.S. Pat. No. 6,959,165, issued Oct. 25, 2005, entitled "HIGH RATE PRINT MERGING AND FINISHING SYSTEM FOR PARALLEL PRINTING," by Barry P. Mandel, et al.;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski, et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. application Ser. No. 11/000,158, filed Nov. 30, 2004, entitled "GLOSSING SYSTEM FOR USE IN A TIPP ARCHITECTURE," by Bryan J. Roof;

U.S. application Ser. No. 11/000,168, filed Nov. 30, 2004, entitled "ADDRESSABLE FUSING AND HEATING METHODS AND APPARATUS," by David K. Biegelsen, et al.;

U.S. application Ser. No. 11/000,258, filed Nov. 30, 2004, entitled "GLOSSING SYSTEM FOR USE IN A TIPP ARCHITECTURE," by Bryan J. Roof;

U.S. Pat. No. 6,925,283, issued Aug. 2, 2005, entitled "HIGH PRINT RATE MERGING AND FINISHING SYSTEM FOR PARALLEL PRINTING," by Barry P. Mandel, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2004, entitled "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473, filed Mar. 16, 2005, entitled "PRINTING-SYSTEM," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application Ser. No. 11/089,854, filed Mar. 25, 2005, entitled "SHEET REGISTRATION WITHIN A MEDIA INVERTER," by Robert A. Clark, et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/090,502, filed Mar. 25, 2005, entitled IMAGE QUALITY CONTROL METHOD AND APPARATUS FOR MULTIPLE MARKING ENGINE SYSTEMS," by Michael C. Mongeon;

U.S. application Ser. No. 11/093,229, filed Mar. 29, 2005, entitled "PRINTING SYSTEM," by Paul C. Julien;

U.S. application Ser. No. 11/095,872, filed Mar. 31, 2005, entitled "PRINTING SYSTEM," by Paul C. Julien;

U.S. application Ser. No. 11/094,864, filed Mar. 31, 2005, entitled "PRINTING SYSTEM," by Jeremy C. dejong, et al.;

U.S. application Ser. No. 11/095,378, filed Mar. 31, 2005, entitled "IMAGE ON PAPER REGISTRATION ALIGNMENT," by Steven R. Moore, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910 filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/109,558, filed Apr. 19, 2005, entitled "SYSTEMS AND METHODS FOR REDUCING IMAGE REGISTRATION ERRORS," by Michael R. Furst, et al.;

U.S. application Ser. No. 11/109,566, filed Apr. 19, 2005, entitled "MEDIA TRANSPORT SYSTEM," by Barry P. Mandel, et al.;

U.S. application Ser. No. 11/109,996, filed Apr. 20, 2005, entitled "PRINTING SYSTEMS," by Michael C. Mongeon, et al.;

U.S. application Ser. No. 11/115,766, filed May 5, 2005, entitled "PRINTING SYSTEM AND SCHEDULING METHOD," by Austin L. Richards;

U.S. application Ser. No. 11/136,959, filed May 25, 2005, entitled "PRINTING SYSTEMS," by Kristine A. German, et al.;

U.S. application Ser. No. 11/137,634, filed May 25, 2005, entitled "PRINTING SYSTEM," by Robert M. Lofthus, et al.;

U.S. application Ser. No. 11/137,251, filed May 25, 2005, entitled "SCHEDULING SYSTEM," by Robert M. Lofthus, et al.;

U.S. C-I-P application Ser. No. 11/137,273, filed May 25, 2005, entitled "PRINTING SYSTEM," by David G. Anderson, et al.;

U.S. application Ser. No. 11/143,818, filed Jun. 2, 2005, entitled "INTER-SEPARATION DECORRELATOR," by Edul N. Dalal, et al.;

U.S. application Ser. No. 11/146,665, filed Jun. 7, 2005, entitled "LOW COST ADJUSTMENT METHOD FOR PRINTING SYSTEMS," by Michael C. Mongeon;

U.S. application Ser. No. 11/152,275, filed Jun. 14, 2005, entitled "WARM-UP OF MULTIPLE INTEGRATED MARKING ENGINES," by Bryan J. Roof, et al.;

U.S. application Ser. No. 11/11/156,778, filed Jun. 20, 2005, entitled "PRINTING PLATFORM," by Joseph A. Swift;

U.S. application Ser. No. 11/157,598, filed Jun. 21, 2005, entitled "METHOD OF ORDERING JOB QUEUE OF MARKING SYSTEMS," by Neil A. Frankel;

U.S. application Ser. No. 11/166,460, filed Jun. 24, 2005, entitled "GLOSSING SUBSYSTEM FOR A PRINTING DEVICE," by Bryan J. Roof, et al.;

U.S. application Ser. No. 11/166,581, filed Jun. 24, 2005, entitled "MIXED OUTPUT PRINT CONTROL METHOD AND SYSTEM," by Joseph H. Lang, et al.;

U.S. application Ser. No. 11/166,299, filed Jun. 24, 2005, entitled "PRINTING SYSTEM," by Steven R. Moore;

U.S. application Ser. No. 11/170,975, filed Jun. 30, 2005, entitled "METHOD AND SYSTEM FOR PROCESSING SCANNED PATCHES FOR USE IN IMAGING DEVICE CALIBRATION," by R. Victor Klassen;

U.S. application Ser. No. 11/170,873, filed Jun. 30, 2005, entitled "COLOR CHARACTERIZATION OR CALIBRATION TARGETS WITH NOISE-DEPENDENT PATCH SIZE OR NUMBER," by R. Victor Klassen;

U.S. application Ser. No. 11/170,845, filed Jun. 30, 2005, entitled "HIGH AVAILABILITY PRINTING SYSTEMS," by Meera Sampath, et al.;

U.S. application Ser. No. 11/189,371, filed Jul. 26, 2005, entitled "PRINTING SYSTEM," by Steven R. Moore, et al.;

U.S. application Ser. No. 11/208,871, filed Aug. 22, 2005, entitled "MODULAR MARKING ARCHITECTURE FOR WIDE MEDIA PRINTING PLATFORM," by Edul N. Dalal, et al.;

U.S. application Ser. No. 11/215,791, filed Aug. 30, 2005, entitled "CONSUMABLE SELECTION IN A PRINTING SYSTEM", by Eric Hamby, et al.;

U.S. application Ser. No. 11/222,260, filed Sep. 8, 2005, entitled "METHOD AND SYSTEMS FOR DETERMINING BANDING COMPENSATION PARAMETERS IN PRINTING SYSTEMS", by Goodman, et al.;

U.S. application Ser. No. 11/234,553, filed Sep. 23, 2005, entitled "MAXIMUM GAMUT STRATEGY FOR THE PRINTING SYSTEMS", by Michael C. Mongeon;

U.S. application Ser. No. 11/234,468, filed Sep. 23, 2005, entitled "PRINTING SYSTEM", by Eric Hamby, et al.;

U.S. application Ser. No. 11/247,778, filed Oct. 11, 2005, entitled "PRINTING SYSTEM WITH BALANCED CONSUMABLE USAGE", by Charles Radulski, et al.;

U.S. application Ser. No. 11/248,044, filed Oct. 12, 2005, entitled "MEDIA PATH CROSSOVER FOR PRINTING SYSTEM", by Stan A. Spencer, et al.; and U.S. application Ser. No. 11/274,638, filed Nov. 15, 2005, entitled "GAMUT SELECTION IN MULTI-ENGINE SYSTEMS", by Wencheng Wu, et al.;

U.S. application Ser. No. 11/287,177, filed Nov. 23, 2005, entitled "MEDIA PASS THROUGH MODE FOR MULTI-ENGINE SYSTEM", by Barry P. Mandel, et al.;

U.S. application Ser. No. 11/287,685, filed Nov. 28, 2005, entitled "MULTIPLE IOT PPHOTORECEPTOR BELT SEAM SYNCHRONIZATION", by Kevin M. Carolan;

U.S. application Ser. No. 11/291,860, filed Nov. 30, 2005, entitled "MEDIA PATH CROSSOVER CLEARANCE FOR PRINTING SYSTEM", by Keith L. Willis;

U.S. application Ser. No. 11/292,388, filed Nov. 30, 2005, entitled "PRINTING SYSTEM", by David A. Mueller;

U.S. application Ser. No. 11/292,163, filed Nov. 30, 2005, entitled "RADIAL MERGE MODULE FOR PRINTING SYSTEM", by Barry P. Mandel, et al.;

U.S. application Ser. No. 11/291,583, filed Nov. 30, 2005, entitled "MIXED OUTPUT PRINTING SYSTEM", by Joseph H. Lang;

U.S. application Ser. No. 11/312,081, filed Dec. 20, 2005, entitled "PRINTING SYSTEM ARCHITECTURE WITH CENTER CROSS-OVER AND INTERPOSER BY-PASS PATH", by Barry P. Mandel, et al.;

BACKGROUND

The present exemplary embodiments relate to a universal variable pitch interface for sheet handling in a modular sheet handling path. In particular, the embodiments relate to variable dimensioned sheet transport apparatus for interfacing between modular copy sheet processing path modules such as transport path sections and machines such as printers, finishers, and the like arranged on a fixed pitch modular grid or path. The embodiments have selectively variable dimensions to take up non-pitch spacings between the fixed-pitch devices disposed in the grid or path, and will be described with particular reference thereto. However, it is to be appreciated that the present exemplary embodiments are also amenable to other applications and similar use as well such as in other material processing or handling systems arranged in a modular path topology.

In a conventional printing apparatus, sheet material or paper is handled by a series of sheet guides, rollers, and counter rollers forming nips and the like, arranged along a paper path. These printing machines typically include functional units on the paper path such as, for example, marking engines, feeders, finishers, inverters, or the like. The nips in the various functional units generate forces normal to the tangential surface of the rollers for urging the sheet materials forward and directing the sheets through the various functional units.

In the past, a wide variety of copiers and printers have been available on the market. However, paper path heights and directions for input and output on these machines have not been consistent across the range of original equipment manufacturers. Therefore, in response to customer demand for greater compatibility with various commercial feeding/finishing equipment to provide more in-line sheet processing options, a "standard" output height has been defined, more or less, by particular suppliers or vendors. However, these standards have been selected without regard to specification of downstream equipment. The task of delivering sheet output to other downstream devices has been handed to paper handling accessory equipment suppliers.

To address the concerns of interconnecting copiers and printers in a system having different paper path heights, U.S. Pat. No. 5,326,093 provides a free-standing movable sheet handling module of a fixed narrow width providing a universal interface for operatively connecting and feeding the sequential copy sheet output of various reproduction machines of widely varying ranges of sheet output level heights to various independent copy sheet processing units having widely varying sheet input level heights. There, a sheet feeding path extends from one side of the fixed width module to the other for transporting the copy sheets. The sheet feeding path is repositionable by vertically repositioning integral sheet path ends opening at opposite sides of the interface module.

The system identified above is highly advantageous when vertical height adjustments must be made between various sheet processing machines disposed along a sequential copy sheet path. However, much momentum has developed in the art recently toward modularity and, in particular, toward providing hypermodular paper paths in sheet processing systems. These hypermodular paper paths are intended to be usable to compose systems consisting of functional units such as marking engines, feeders, finishers, inverters, and the like, which need not be constrained in the positions of their respective inputs and outputs. Essentially, hypermodular paper path arrays include paper path modules repeating on fixed pitches to form a grid-like arrangement of transport units. Each of the hypermodules is constrained to have a predefined "standard" horizontal and vertical dimension in conformance with a pre-established physical connection convention, enabling the hypermodules to be easily and quickly assembled in a grid-like array.

Often, there is a need to connect processing machines with inputs and outputs separated by arbitrary distances, where, in particular, the distances are not commensurate with the fixed pitch of the sheet processing hypermodules. Moreover, there may at times be a need to couple an established first hypermodular sheet processing array with an established second hypermodular sheet processing array into a single, larger, modular array as by providing a hypermodular paper bridge path therebetween.

The above-noted connections are straightforward when the arbitrary distance between the respective inputs and outputs of the individual sheet processing machines match the fixed pitch of the sheet handling hypermodules. Also, in instances where a first grid defined by a first hypermodular sheet processing array is coincident with a second grid defined by a second hypermodular sheet processing array, connection of the hypermodular paper path therebetween is relatively straightforward. However, when the first and second sheet processing arrays fall on non-overlapping grids, there is a need for one or more non-fixed size elements providing a universal dimensionally variable pitch interface interconnecting the fixed pitch sheet processing machines in the first and second sheet processing arrays.

The present embodiments provide variable dimensioned paper path modules which overcome the above-referenced problems, and others.

BRIEF DESCRIPTION

In accordance with one aspect of the present exemplary embodiment, a universal interface is provided for operatively connecting and feeding sequential copy sheet output of various selectable first sheet processing machines to various selectable second sheet processing machines spaced apart horizontally or horizontally and vertically from the first sheet processing machines by varying ranges of horizontal or horizontal and vertical distances. The universal interface includes a frame and a universal interface module providing a sheet feeding path repositionable relative to the frame therethrough, from one side to the other of the module, for transporting the copy sheet output of the first sheet processing machine to the copy sheet input of the second sheet processing machine. Further, the universal interface module includes integral horizontally repositionable sheet receiving and sheet discharging sheet path ends opening at opposite sides of the universal interface module. At least one of the sheet receiving path end and the sheet discharging sheet path end is independently positionable relative to the other of the sheet receiving and sheet discharging sheet path ends over a horizontal range.

In accordance with another aspect of the present exemplary embodiment, the sheet receiving sheet path end is integral with the sheet feeding path provided in the universal interface module. Similarly, the sheet discharging sheet path is integrally formed with the sheet feeding path of the universal interface module.

In accordance with yet another aspect of the present exemplary embodiments, a positioning system is provided in the universal interface in operative association with the frame for orienting the sheet receiving path end and the sheet discharging sheet path end at selective positions relative to the frame. In its preferred form, the positioning system includes a set of linkages forming a parallelogram. Still further, the set of linkages includes first and second telescoping struts.

In accordance with yet another aspect of the present exemplary embodiments, the universal interface further includes a connection system for retaining the sheet receiving and sheet discharging sheet path ends at selected desired positions mating the selected first and second sheet processing machines.

In accordance with a still further embodiment, a bidirectional universal interface is provided. The bidirectional universal interface includes a frame and a universal interface module including a sheet feeding path repositionable relative to the frame therethrough, from opposite sides of the module, for transporting copy sheets between first and second sheet processing machines. The ends of the sheet path are selectively functional as either input ends or output ends to provide for a bidirectional sheet flow through the interface. Further, ends of the receiving/discharging sheet path are independently repositionable relative to the other of the receiving/discharging sheet path over a horizontal range or over a vertical and horizontal range.

In accordance with yet a further aspect of the present exemplary embodiments, a sheet path is defined through the module by sheet path guide means. In their preferred form, a pair of tambour devices are provided in association with the universal interface module on opposite sides of the sheet feeding path for guiding work pieces including copy sheets through the universal interface. In addition, a plurality of sheet guide members are disposed on opposite ends of the sheet feeding path at at least one of the sheet receiving and the sheet discharging sheet path ends thereof. In accordance with a further aspect, at least one nip is selectively disposed at the sheet receiving sheet discharging sheet path end of the sheet feeding path of the universal interface module.

The term "marking device" as used herein broadly encompasses various printers, copiers or multi-function machines or systems, xerographic or otherwise, unless otherwise specified in a claim.

A "printing system" as used herein incorporates a plurality of marking devices, feeders, finishers, or other sheet processing or handling machines.

The term "sheet" herein refers to a physical sheet of paper, flat stock articles, plastic, or other suitable physical print media substrate for images, whether precut or web fed. The term "sheet" also encompasses other generally planar items, whether to be printed or not, unless otherwise specified in a claim.

"Flexible media," as used herein, broadly encompasses print media substrates for images as well as other generally planar objects which are not necessarily undergoing an imaging process, including items of mail, bank notes, flexible display substrates, and the like.

A "finisher" as broadly used herein, is any post-printing accessory device such as an inverter, reverter, sorter, mail box, inserter, interposer, folder, stapler, stacker, collator, stitcher, binder, over-printer, envelope stuffer, postage machine, or the like.

DETAILED DESCRIPTION

The disclosed universal interface provides a simple but highly adjustable paper path transport that enables a wide range of variable pitch bridge-type interface interconnections between fixed pitch sheet processing machines. The highly flexible and adaptable interface units such as described in the present application eliminate substantial engineering time and work for separate specialized interfaces otherwise needed for interfacing particular hypermodular sheet processing arrays as well as for constructing single hypermodular sheet processing arrays which have the need for various reasons for a variable pitch portion interconnecting otherwise regularly spaced and sized sheet processing machines. The disclosed universal interface readily provides for a variable dimension or dimensions which may be substantially different from the pitch of the corresponding hypermodular sheet processing array in which it is connected. Preferably, the nominal length of the universal interface is a fraction of the length of the associated hypermodular array pitch L. The interface is adjustable from a minimized length B, limited by the compressed length of the internal components of the module, to an expanded length L+B. Any gaps in the hypermodular array beyond this range can be accommodated using a single universal module and an integer number of fixed pitch L modules.

Figure 1:
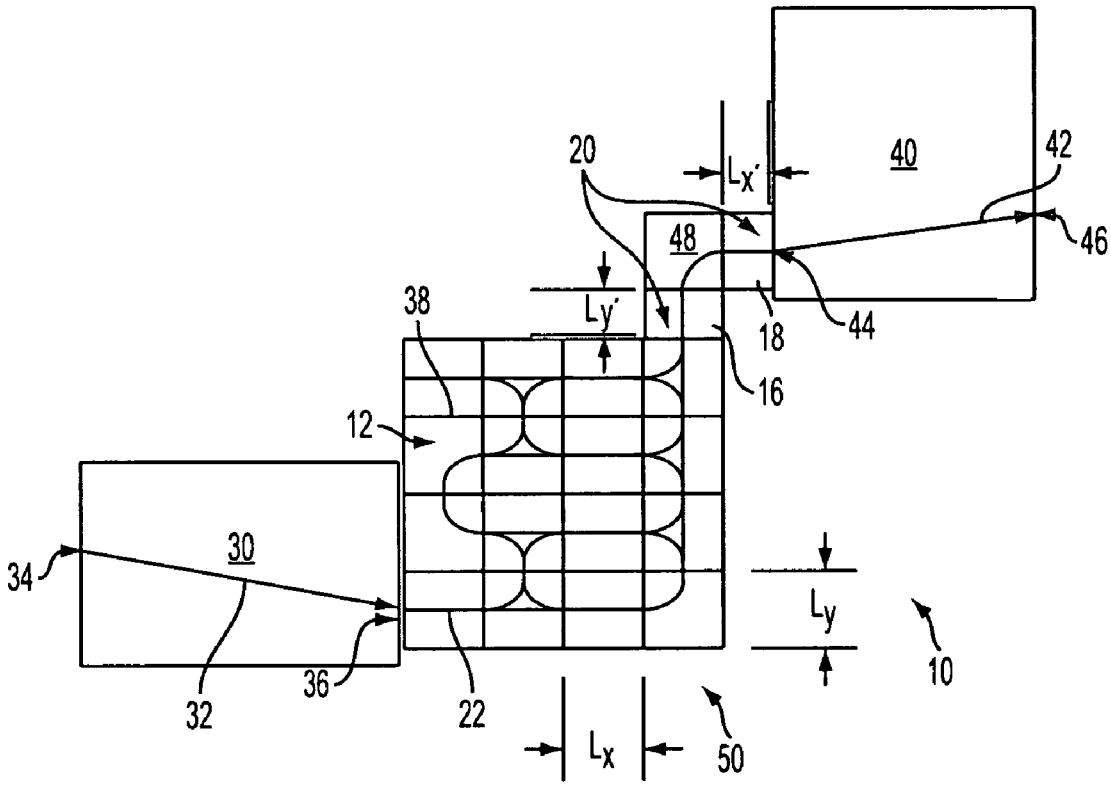
FIG. 1 is a schematic side view of a first embodiment of a universal interface interconnecting a pair of associated sheet processing machines in a hypermodular sheet processing array.

Turning now to the figures wherein the showings are for purposes of illustrating the preferred embodiments only and not for limiting same, FIG. 1 is a schematic side view of a sheet processing system 10 including a hypermodular sheet processing array 12 and intermediary universal interfaces 20 connecting a first sheet processing machine 30 with a second sheet processing machine 40. The intermediary universal interfaces 20 include first and second universal interface modules 16, 18 formed in accordance with preferred embodiments of the application.

As shown, the first sheet processing machine 30 defines a first sheet path 32 extending between a sheet receiving end 34 of the processing machine 30 and a sheet discharging end 36 thereof. The paper path is illustrated as an arrow. The first sheet processing machine 30 is aligned with a first grid 38 defined by the hypermodular sheet processing array 12 which, in the embodiment illustrated, is two dimensional and rectangular. However, it is to be appreciated that the preferred embodiments are equally applicable to three dimensional arrays as well as to use between any pair of sheet processing machines.

Similarly, the sheet processing system 10 includes a second sheet processing machine 40 defining a second sheet path 42 extending therethrough from a second sheet receiving end 44 of the processing machine 40 to a second sheet discharging end 46 of the machine. As illustrated, the second sheet processing machine 40 is generally aligned with a portion of the hypermodular sheet processing array 12, preferably having the form of a right angle turn module 48.

With continued reference to FIG. 1, the intermediary universal interfaces 20 are used to adapt the hypermodular sheet feed modules 48, 50 for operative connection between the first and second sheet processing machines 30, 40. The first set of sheet feed modules 50 extend as a regular repeating block from the first sheet processing machine 30 for moving the sheets along a first portion of a continuous sheet path 22 connecting the first sheet path 32 of the first sheet processing machine 30 with a second sheet path 42 of the second sheet processing machine 40 via the right angle turn module 48. The right angle turn module 48 is on the grid 38 of the first set of sheet feed modules and defines a second portion of the sheet path 22 extending between the first and second sheet processing machines 30, 40. It is to be appreciated that the first set of sheet feed modules 50 defines a rectangular grid 38 having a first pitch $L_x$ in a first horizontal direction and relative to the first and second sheet processing machines 30, 40. Similarly, the sheet feed modules define a second pitch $L_y$ in a vertical direction and in the plane of the drawing sheet relative to the first and second sheet processing machines. As illustrated, the first and second pitches preferably have the same or an equivalent nominal size and the grid defines orthogonal axes. However, it is to be understood that the first and second pitches can have different lengths to form a rectangular grid and, further, the grid can define axes skewed in one or more dimensions to form a parallelogram grid.

The universal interfaces 20 include a first universal interface module 16 disposed between the first and second set of sheet feed modules for accommodating a vertical pitch spacing difference $L_y$' between the hypermodular sheet processing array 12 and the second sheet processing machine 40. Similarly, the second universal interface module 18 is provided in the system 10 for accommodating pitch spacing differences along a horizontal pitch direction $L_x$' between the hypermodular sheet processing array 12 and the second sheet processing machine 40.

It is to be further emphasized that the sheet processing system 10 illustrated in the figure includes sheet feed modules having matching longitudinal and lateral pitches $L_x$, $L_y$, respectively for simplification and ease of description purposes. However, the respective pitches can be other than those shown. Essentially, the universal interface modules of the preferred embodiments are useful to bridge variable distances between module inputs and outputs in horizontal, vertical, and combined horizontal and vertical directions between devices in hypermodular arrays. By utilizing the preferred interface modules described in the present application between inputs and/or outputs of functional units, the remainder of the paper path between the sheet processing machines 30, 40, and the like can utilize standard hypermodular sheet feed modules 50, 52, etc. disposed in a fixed pitch array as illustrated. More generally, the universal interface modules 16, 18 comprising the universal interfaces 20 allow coupling between functional units which have arbitrary relative positions therebetween.

Figure 1A:
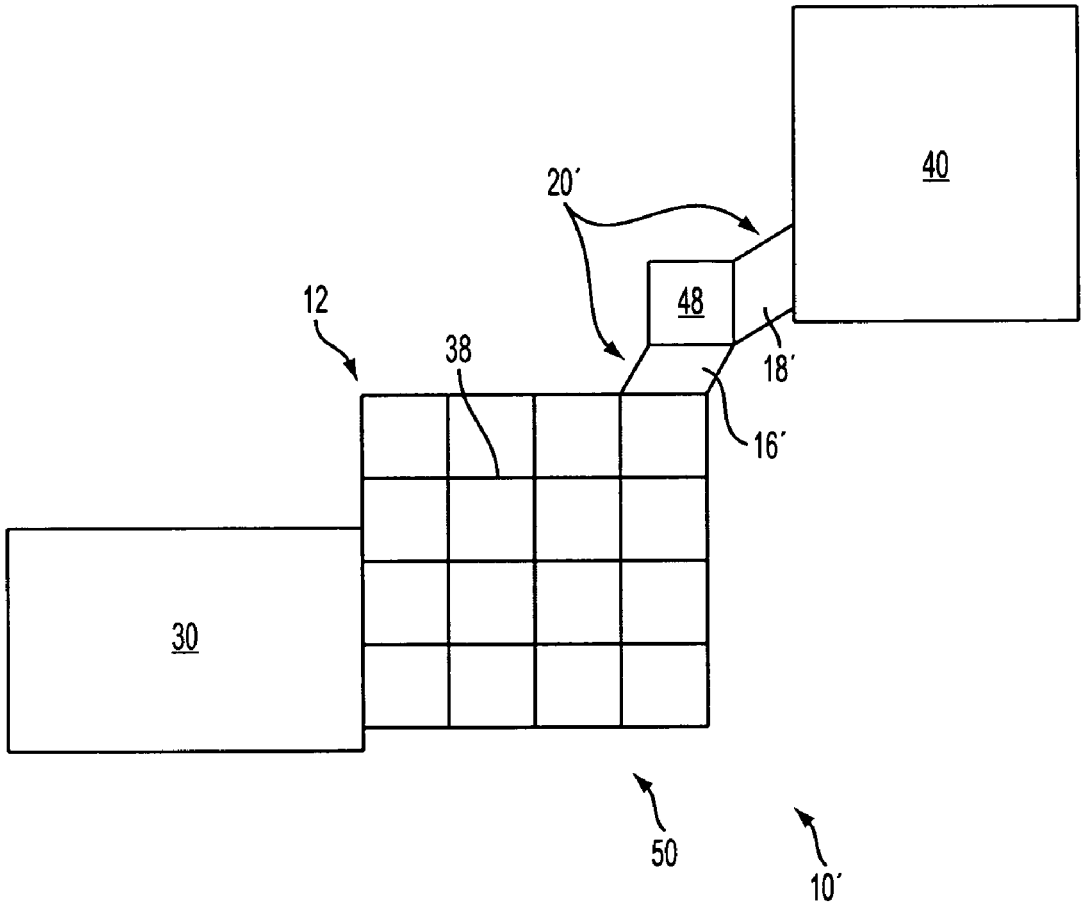
FIG. 1*a* is a schematic view of an alternative first embodiment as shown in FIG. 1 illustrating universal interfaces arranged in a parallelogram conformation in a hypermodular sheet processing array.

To show the versatility of the subject embodiments, FIG. 1*a* illustrates a sheet processing system 10' including the hypermodular sheet processing array 12 from FIG. 1, but using alternative intermediary universal interfaces 20' connecting the first sheet processing machine 30 with the second sheet processing machine 40. The intermediary universal interfaces include first and second universal interface modules 16', 18' formed in accordance with further embodiments of the present application. In FIG. 1*a*, the second machine 40 is moved relative to the first machine 30 based on the initial arrangement shown schematically in FIG. 1.

In the embodiment shown schematically in FIG. 1*a*, each of the universal interface modules 16', 18' are movable in both horizontal and vertical directions to form a parallelogram of selected dimensions. This accommodates the potential need in the art to provide for several processing machines being located off of one or more of the grid axes.

Figure 2:
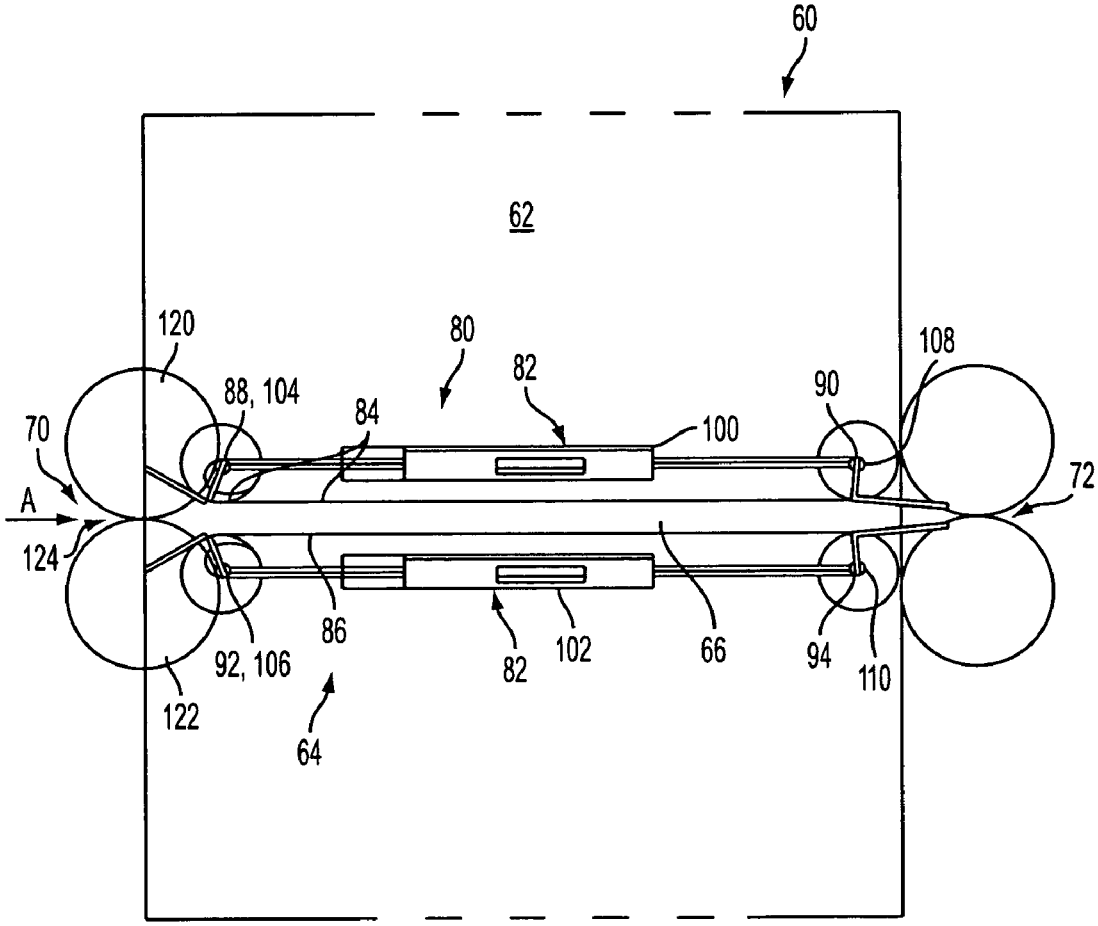
FIG. 2 is a schematic side view of a first embodiment of a universal interface in accordance with the present application.
Figure 3:
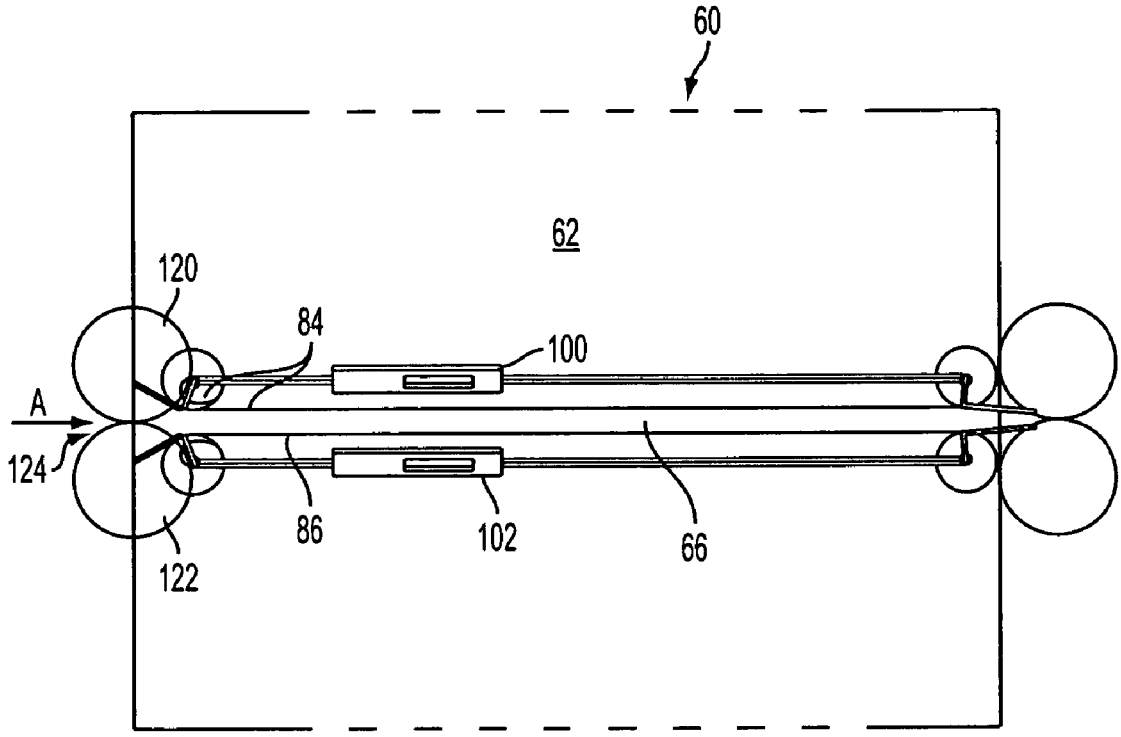
FIG. 3 is schematic side view of the universal interface of FIG. 1 disposed in a horizontally extended position relative to FIG. 2.

To the above end, and with reference next to FIG. 2, the preferred form of the subject universal interface is a telescopic universal interface module 60 movable between the positions illustrated in FIGS. 2 and 3 in horizontal or vertical directions relative to the sheet processing system 10 described above. The telescopic universal interface module 60 embodiment illustrated, however, provides a single degree of freedom in a horizontal direction in terms of the sheet processing system for adaptive connection between devices arranged in corresponding hypermodular sheet processing arrays. FIG. 3 shows the module 60 extended to a length comparable to or slightly greater than the horizontal pitch $L_x$. FIG. 2 shows the module 60 collapsed to a fraction of the pitch $L_x$ less than the fraction of $L_x$ shown in FIG. 3.

In its preferred form, the telescopic universal interface module 60 includes a frame 62 and a universal interface module 64 providing a sheet feeding path 66 positional relative to the frame 62 therethrough. The sheet feeding path 66 extends from one side of the module to the other as illustrated. More particularly, the sheet feeding path extends between a sheet receiving sheet path end 70 of the sheet feeding path 66 to a sheet discharging sheet path end 72 of the sheet feeding path 66. As understood by those skilled in the art, the sheet feeding path 66 is provided for transporting copy sheets output from an associated first sheet processing machine to an associated copy sheet input of a second sheet processing machine in a direction A marked in the figure.

Figure 2A:
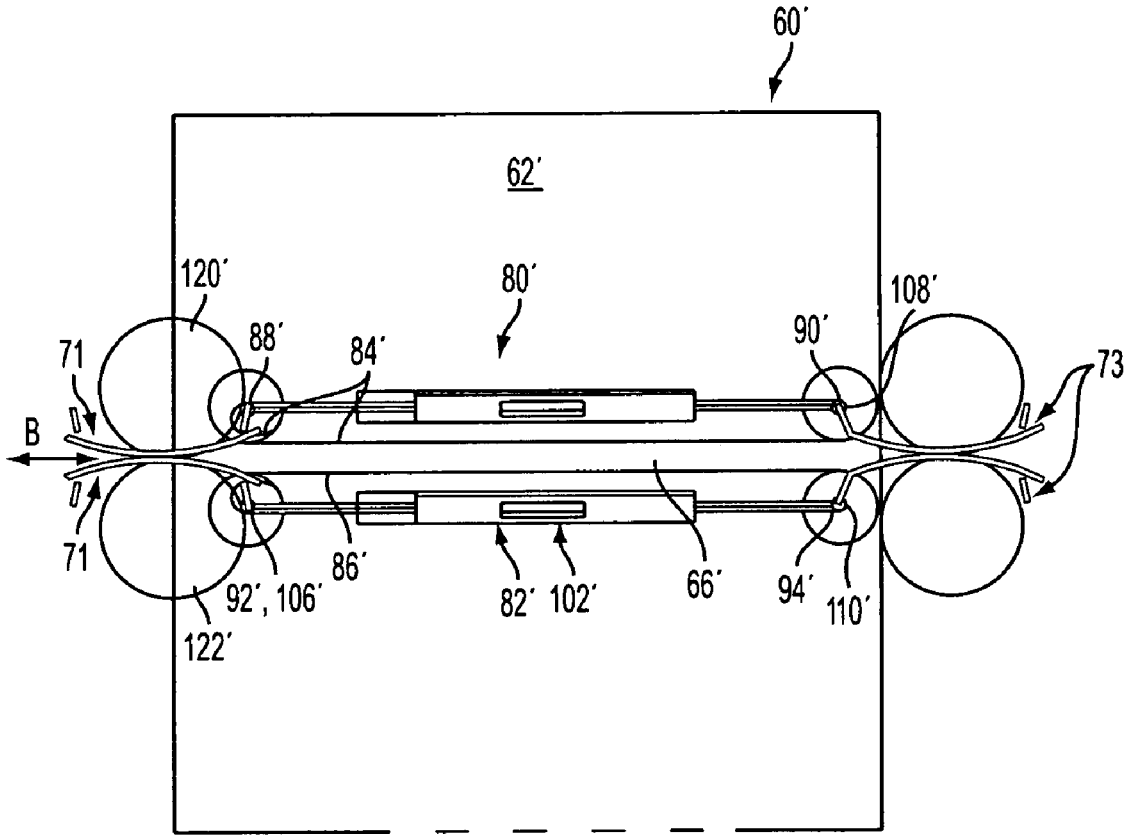
FIG. 2*a* is a schematic side view of an alternative first embodiment of a bidirectional universal interface in accordance with the present application.

FIG. 2*a* shows an alternative preferred form of the subject universal interface module 60' movable between the positions illustrated in FIGS. 2*a* and 3 in horizontal or vertical directions relative to the sheet processing system 10 described above. The telescopic universal interface module 60' embodiment illustrated in FIG. 2*a* provides a bidirectional paper feed path therethrough and, in that regard, offers alternative functionality relative to the first embodiment illustrated in FIG. 2. As in FIG. 2, the bidirectional universal interface module 60' extends a length comparable to or slightly greater than the horizontal pitch $L_x$. FIG. 2*a* shows the bidirectional module 60' collapsed to a fraction of the pitch $L_x$ less than the fraction of $L_x$ shown in FIG. 3.

In the form illustrated, the bidirectional telescopic universal interface module 60' includes a frame 62' and a universal interface module 64' providing a bidirectional sheet feeding path 66' positional relative to the frame 62' therethrough. The bidirectional sheet feeding path 66' extends between opposite sides of the module as illustrated. More particularly, the bidirectional sheet feeding path extends between a sheet receiving/discharging sheet feed path end 70' of the sheet feeding path 66' to a sheet receiving/discharging sheet feed path end 72' of the sheet feeding path 66'. As understood by those skilled in the art, the bidirectional sheet feeding path 66' is provided for transporting copy sheets between the associated first and second sheet processing machines in directions B marked in the figure.

The bidirectional telescopic universal interface module 60' includes additional sheet feeding guides 71, 73 at opposite sides of the bidirectional sheet feeding path 66'. The additional sheet guides 71, 73 are provided to enable jam-free transfer of sheets across the module boundaries. In their preferred form, the additional guides are formed so as to be cooperative with similar guides on like modules for joining in an interdigitated fashion as understood by those skilled in the art. The interdigitated additional sheet feed guides enable smooth transition and transfer of sheets across the module boundaries.

With continued references to FIGS. 2 and 3, the sheet discharging sheet path end 72 of the sheet feeding path 66 is independently positionable relative to the sheet receiving sheet path end over a range which extends from the position illustrated in FIG. 2 to the position illustrated in FIG. 3. Essentially, the sheet discharging end is telescoped relative to the sheet receiving end from the orientation shown in FIG. 2 in a single degree of freedom to the configuration shown in FIG. 3.

A positioning system 80 includes a set of linkages 82 for holding a pair of opposed tambour devices 84, 86 on opposite sides of the sheet feeding path 66. In their preferred form, the tambour devices 84, 86 are anchored at opposite ends 88, 90 and 92, 94, respectively to form rolls or the like. It is to be appreciated that devices or mechanisms other than the tambour devices illustrated can be used to define the sheet feeding path 66 including but not limited to any form of telescoping walls, stretchable membrane walls and the like.

In the preferred form illustrated, the linkage 82 include first and second parallel telescoping struts 100, 102 connected at opposite ends to the ends of the tambour devices 94, 96. The struts 100, 102 are connected to the frame 62 at first ends 104, 106, thereof as well as at second ends 108, 110 to thereby form a parallelogram. In that way, the struts 100, 102 form a cantilever by support at their first ends 104, 106.

A pair of opposed rollers 120, 122 define a nip 124 at the receiving end 70 of the sheet feed path 66. The rollers are motivated by an operatively associated motor, linkage, and controller system (not shown) for moving sheets along the path in the direction A. It is to be appreciated that the nip can be located in the universal interface module or in the adjacent hypermodule as desired. Preferably, however, the nip center line is placed at or is arranged to be coincident with the module boundary in accordance with the present embodiments.

In addition to the above, a first pair of paper guides 120 are carried in association with the rollers and the struts for guiding the work sheets through the nip and between the tambour devices 84, 86 along the paper path. Similarly, a pair of exit paper guides are provided to ensure that the copy sheets exit the paper path in the desired direction.

Figure 4:
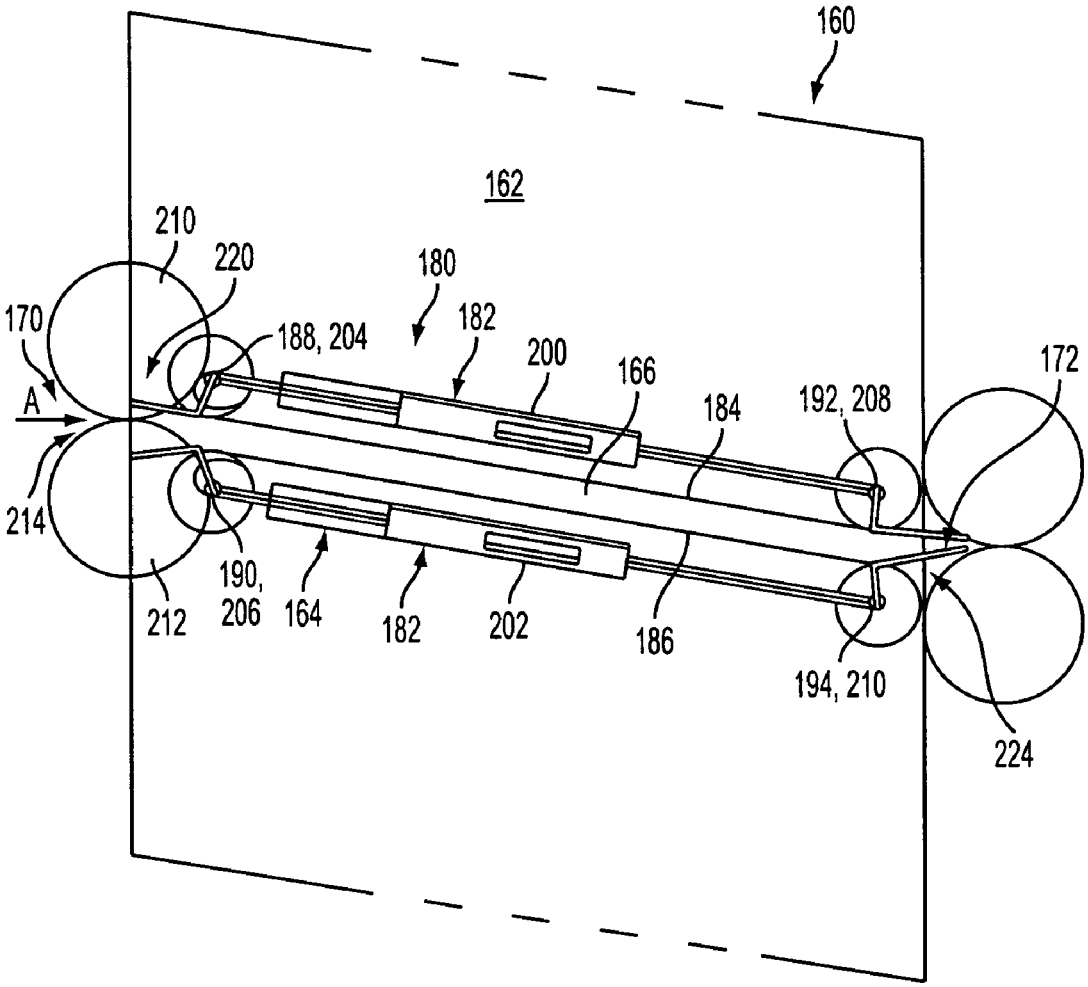
FIG. 4 is a schematic side view of the universal interface of FIG. 1 disposed in a both horizontally and vertically extended orientation relative to FIG. 2.

With reference next to FIG. 4, a universal interface module 160 formed in accordance with a second embodiment of the application is illustrated. As shown there, the module 160 is telescopic in two degrees of freedom in both horizontal and vertical directions in terms of the sheet processing system for adaptive connection between devices arranged in corresponding hypermodular sheet processing arrays.

In its preferred form, the telescopic universal interface module 160 includes a frame 162 and a universal interface module 164 providing a sheet feeding path 166 positional relative to the frame 162 therethrough. The sheet feeding path 166 extends from one side of the module to the other as illustrated. More particularly, the sheet feeding path extends between a sheet receiving sheet path end 170 of the sheet feeding path 166 to a sheet discharging sheet path end 172 of the sheet feeding path 166. As understood by those skilled in the art, the sheet feeding path 166 is provided for transporting copy sheets output from an associated first sheet processing machine to an associated copy sheet input of a second sheet processing machine in a direction A marked in the figure.

With continued reference to FIG. 4, the sheet discharging sheet path end 172 of the sheet feeding path 166 is independently positionable relative to the sheet receiving sheet path end over a range which extends from the position illustrated in FIG. 2 to the position illustrated in FIG. 4. Essentially, the sheet discharging end is telescoped relative to the sheet receiving end from the orientation shown in FIG. 2 in two single degrees of freedom to the orientation shown in FIG. 4.

A positioning system 180 includes a set of linkages 182 for holding a pair of opposed tambour devices 184, 186 on opposite sides of the sheet feeding path 166. In their preferred form, the tambour devices 184, 186 are anchored at opposite ends 188, 190 and 192, 194, respectively to form rolls or the like. Other structures can be used as well such as interdigitized plastic or metal walls, elastic membranes, etc. Also, the tambour devices can be formed of metal, plastic, or any other suitable material as desired.

In the preferred form illustrated, the linkage 182 includes first and second parallel telescoping struts 200, 202 connected at opposite ends to the ends of the tambour devices 194, 196. The struts 200, 202 are connected to the frame 162 at first ends 204, 206, thereof as well as at second ends 208, 210 to thereby form a parallelogram. In that way, the struts 200, 202 form a cantilever by support at their first ends 204, 206.

A pair of opposed rollers 210, 212 define a nip 214 at the receiving end 170 of the sheet feed path 166. The rollers are motivated by an operatively associated motor, linkage, and controller (not shown) for moving sheets along the path in the direction A.

In addition to the above, a first pair of paper guides 220 are carried in association with the rollers and the struts for guiding the work sheets through the nip and between the tambour devices 184, 186 along the paper path. Similarly, a pair of exit paper guides 224 are provided to ensure that the copy sheets exit the paper path in the desired direction.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A modular printing system comprising:

a first sheet processing machine;

a second sheet processing machine spaced apart from the first sheet processing machine within a range of horizontal distances, with respect to ground; and, a bidirectional universal interface including:

a frame;

a universal interface module coupled with the frame providing a repositionable bidirectional sheet feeding path therethrough, from one side to the other of the universal interface module, for transporting copy sheets between the first sheet processing machine and the second sheet processing machine; and sheet receiving and sheet discharging sheet path ends disposed at opposite sides of said repositionable bidirectional sheet feeding path of the universal interface module, at least one of the sheet path ends being independently repositionable relative to the other of the sheet path ends for bridging said range of said horizontal distances and a variable width, at least one of the sheet path ends of the bidirectional universal interface are independently repositionable relative to the other of the sheet path ends over a vertical range of vertical distances transverse to said range of said horizontal distances in addition to being independently repositionable relative to the other of the sheet path ends over said range of said horizontal distances, wherein said second sheet processing machine is spaced apart from the first sheet processing machine in a two-dimensional spacing, wherein said two-dimensional spacing includes a grid arrangement between said first and second sheet processing machines of at least one fixed-pitch devices having a horizontal fixed pitch and a vertical fixed pitch, wherein said two-dimensional spacing includes a horizontal non-pitch spacing and a vertical non-pitch spacing, and wherein said bidirectional universal interface is disposed in the two-dimensional spacing to bridge said horizontal non-pitch spacing and said vertical non-pitch spacing.

2. The modular printing system according to claim 1 wherein said sheet receiving sheet path ends are integral with said repositionable bidirectional sheet feeding path in said bidirectional universal interface module.

3. The modular printing system according to claim 2 further including:

a positioning system operatively associated with said frame for orienting at least one of said sheet path ends at selected positions relative to said frame, the positioning system including a set of linkages operatively connected with said frame, the set of linkages forming a parallelogram.

4. The modular printing system according to claim 1 further including:

a plurality of sheet guide members disposed at said sheet path ends for guiding associated copy sheets through the bidirectional universal interface module, the plurality of sheet guide members being configured for selective interdigitated connection with associated corresponding other bidirectional universal interfaces.

5. The modular printing system according to claim 1, said bidirectional universal interface further including:

a positioning system operatively associated with said frame and with said universal interface module for orienting at least one of said sheet receiving sheet path end and said sheet discharging sheet path end at selected positions relative to said frame, wherein said positioning system includes a set of linkages operatively connected with said frame, the set of linkages forming a parallelogram, wherein said set of linkages includes first and second telescoping struts, wherein at least one of the sheet receiving sheet path end and the sheet discharging sheet path end is independently repositionable relative to the other of the sheet receiving sheet path end and the sheet discharging sheet path end over a range of vertical distances transverse to said range of horizontal distances in addition to being independently repositionable relative to the other of the sheet receiving sheet path end and the sheet discharging sheet path end over said range of said horizontal distances, and wherein said repositionable sheet feeding path provided by the universal interface module is bidirectional for transporting sheets between a sheet output of the first processing machine and a sheet input of the second processing machine;

a connector system, operatively associated with said frame, for connecting the universal interface module with at least one of said first and second sheet processing machines to position at least one of said sheet receiving sheet path end and said sheet discharging sheet path end at selected positions relative to said at least one of said first and second sheet processing machines;

a plurality of sheet guide members disposed at said sheet receiving sheet path end and said sheet discharging sheet path end for guiding associated sheets through the universal interface module, wherein said plurality of sheet guide members include interdigitated guide members configured to be cooperative with guide members of an adjacent interface module to enable jam-free transfer of the sheets across a boundary formed between the universal interface module and the adjacent interface module; and at least one nip for urging an associated sheet through said universal interface module, wherein said at least one nip is disposed at said sheet receiving sheet path end of the repositionable bidirectional sheet feeding path.

* * * * *